US006578390B2

(12) United States Patent
Chang

(10) Patent No.: US 6,578,390 B2
(45) Date of Patent: Jun. 17, 2003

(54) ANTI-PILLING MACHINE

(76) Inventor: Chi-Lung Chang, PO Box 82-144, Taipei (TW)

( * ) Notice: Subject to any disclaimer, the term of this patent is extended or adjusted under 35 U.S.C. 154(b) by 0 days.

(21) Appl. No.: 09/987,781

(22) Filed: Nov. 16, 2001

(65) Prior Publication Data

US 2003/0094020 A1 May 22, 2003

(51) Int. Cl.[7] ..... D06B 3/28
(52) U.S. Cl. ..... 68/5 C; 68/20
(58) Field of Search ..... 68/5 C, 20; 34/642, 34/643, 644

(56) References Cited

U.S. PATENT DOCUMENTS 4,005,500 A * 2/1977 Rayment ..... 68/5 C X
4,829,620 A * 5/1989 Christ et al. ..... 68/5 C X
4,862,546 A * 9/1989 von der Eltz et al. .... 68/5 C X
5,014,525 A * 5/1991 Bene ..... 68/20

* cited by examiner

*Primary Examiner*—Philip R. Coe

(57) ABSTRACT

An anti-pilling machine is constructed includes a machine body defining a cylindrical receiving chamber and a cloth passage for the circulation of a fed piece of cloth, an air nozzle upwardly mounted in one end of the cloth passage and adapted for ejecting a jet of hot dry air to move the fed piece of cloth through the cloth passage, a steam nozzle adapted for moistening the moving piece of cloth, an air blower adapted for providing forced air to the air nozzle, and a heat exchanger adapted for heating and drying forced air passing from the air blower to the air nozzle.

2 Claims, 2 Drawing Sheets

ANTI-PILLING MACHINE

BACKGROUND OF THE INVENTION

The present invention-relates to an anti-pilling machine and, more particularly to such an anti-pilling machine, which uses a steam nozzle to moisten the fed piece of cloth, and an air nozzle to provide hot dry air to move the fed piece of cloth through the cloth path, enabling the pilling of the fed piece of cloth to be rubbed against the inside wall of the machine body and forced to roll up.

In order to roll up the pilling of a piece of finished piece of cloth, an anti-pilling machine shall be used. A regular anti-pilling machine is similar to a cloth-drying machine comprised of a machine base and a barrel supported on the machine base. During operation, the piece of cloth to be treated is fed into the barrel of the anti-pilling machine, and then the barrel is alternatively rotated back and forth to force the fed piece of cloth to rub against the inside wall of the barrel, causing the pilling to be rolled up. This design of anti-pilling machine is still not satisfactory in function because of the following drawbacks.

1. The anti-pilling machine can only treat one piece of cloth at a time.
2. When stopping the anti-pilling machine after the treatment of one piece of cloth for the feeding of another piece of cloth, much heat energy is lost, and the heat source must be started again to compensate the lost amount of heat energy.
3. Because the feeding of pieces of cloth and the removal of treated pieces of cloth are manually operated, the working efficiency of the anti-pilling machine is low.
4. After the treatment of one piece of cloth it takes much time to cool down the treated piece of cloth in the air.
5. The piece of cloth tends to be twisted and tangled during treatment, and the operator shall have to spend a lot of time to spread out the treated piece of cloth.

SUMMARY OF THE INVENTION

The present invention has been accomplished to provide an anti-pilling machine, which eliminates the aforesaid drawbacks. It is one object of the present invention to provide an anti-pilling machine, which is practical to treat multiple pieces of cloth at a time. It is another object of the present invention to provide an anti-pilling machine, which automatically treats the fed pieces of cloth. It is still another object of the present invention to provide an anti-pilling machine, which prevents the loss of heat energy during treatment. It is still another object of the present invention to provide an anti-pilling machine, which keeps the fed pieces of cloth in an extended out condition during treatment, preventing the fed pieces of cloth from wrinkling. It is still another object of the present invention to provide an anti-pilling machine, which enables the treated pieces of cloth to be immediately cooled down so that the operator can pick up the treated pieces of cloth safely and conveniently. To achieve these and other objects of the present invention the anti-pilling machine comprises a machine body, the machine body defining a cylindrical receiving chamber and a cloth passage for the circulation of fed pieces of cloth, the receiving chamber having affront end and a rear end, the cloth passage having a front input end terminating in a smoothly arched front bent and a rear output end connected to the rear end of the receiving chamber, an air nozzle coupled to the front bent of the cloth passage and arranged in an upwardly extended position and adapted for ejecting a stream of air toward the fed piece of cloth to force the fed piece of cloth from said receiving chamber into said cloth passage, said air nozzle having an input end downwardly facing the front end of said receiving chamber, a steam nozzle suspended between the air nozzle and the front end of the receiving chamber, an air blower disposed outside the machine body and adapted for providing forced air to the air nozzle, and a heat exchanger connected between the air blower and said air nozzle and adapted for heating and drying forced air passing from the air blower to the air nozzle.

DETAILED DESCRIPTION OF THE PREFERRED EMBODIMENT

Figure 1:
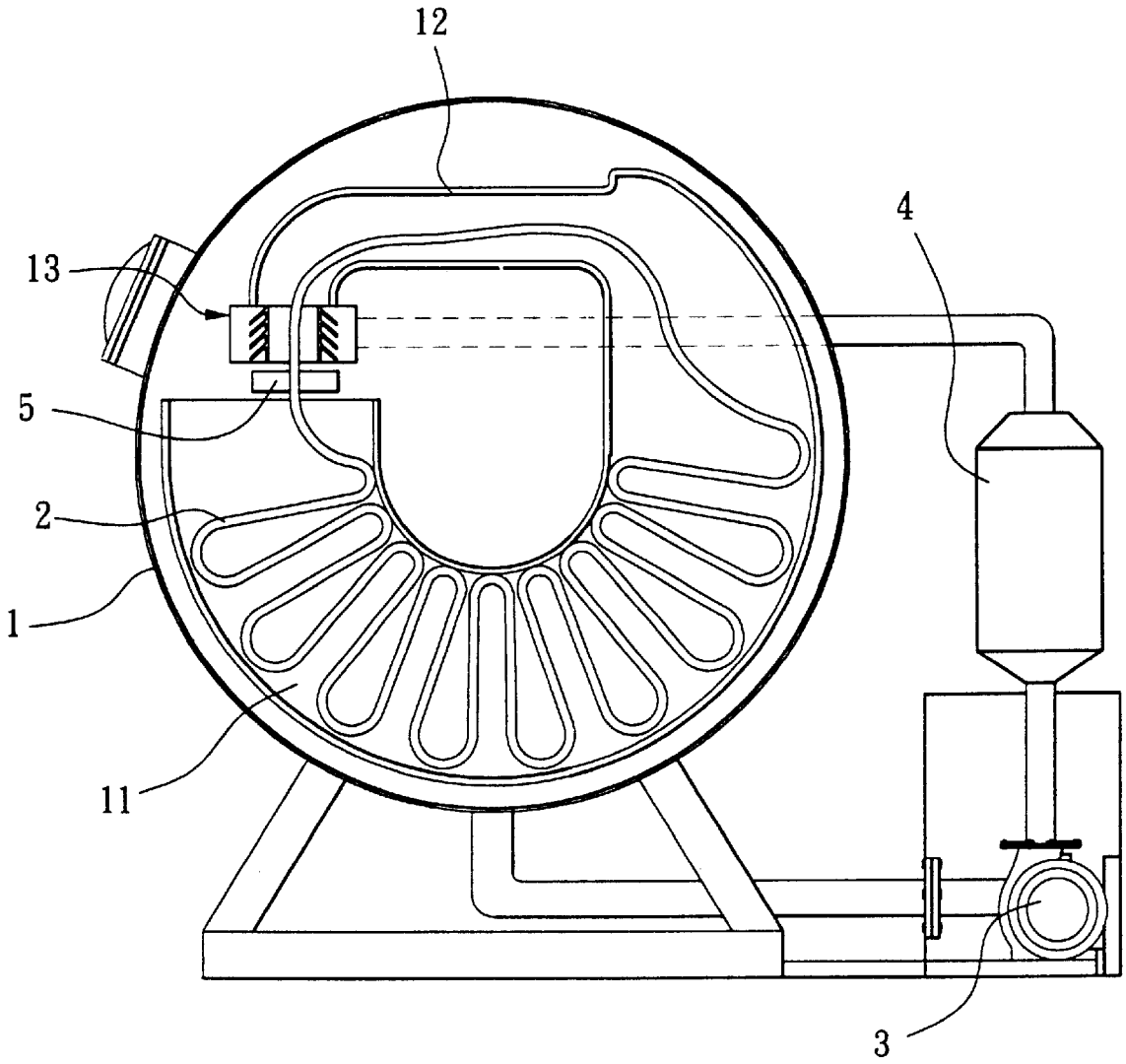
FIG. 1 is a plain view of an anti-pilling machine constructed according to the present invention.

Referring to FIG. 1 an anti-pilling machine is shown comprising a machine body 1, an air blower 3, and a heat exchanger 4. The machine body 1 comprises a cylindrical receiving chamber 11, a cloth passage 12, an air nozzle 13, and a steam nozzle 5. The cloth passage 12 has a front input end terminating in a smoothly arched front bent, and a rear output end connected to one end of the receiving chamber 11. The air nozzle 13 is coupled to the front bent of the cloth passage 12 and arranged in an upwardly extended position. The input end of the air nozzle 13 faces downwards and aimed at the other end of the receiving chamber 11. The steam nozzle 5 is suspended between the air nozzle 13 and the receiving chamber 11. Thus the air nozzle 13, the steam nozzle 5, the cloth passage 12, and the receiving chamber 11 form a continuous cloth circulation path. The air blower 3 is connected to the air nozzle 13 by an air pipe. The heat exchanger 4 is installed in the air pipe between the air blower 3 and the air nozzle 13.

During operation, the air blower provides forced air to the air nozzle 13 through the heat exchanger 4. When passing through the heat exchanger 4 forced air is heated and dried. Therefore, hot dry air is ejected out of the air nozzle 13 to force the fed piece of cloth 2 from the receiving chamber 11 into the cloth passage 12 through the steam nozzle 5. During circulation of the piece of cloth 2 in the cloth path, the steam nozzle 5 is controlled to eject a stream of steam onto the moving piece of cloth 2, causing the moving piece of cloth 2 to be slightly moistened. Continuously circulating the piece of cloth 2 in the cloth path causes the pilling of the fabric structure of the moving piece of cloth 2 to be rolled up due to friction between the pilling of the moving piece of cloth 2 and the inside wall of the receiving chamber 11.

Figure 2:
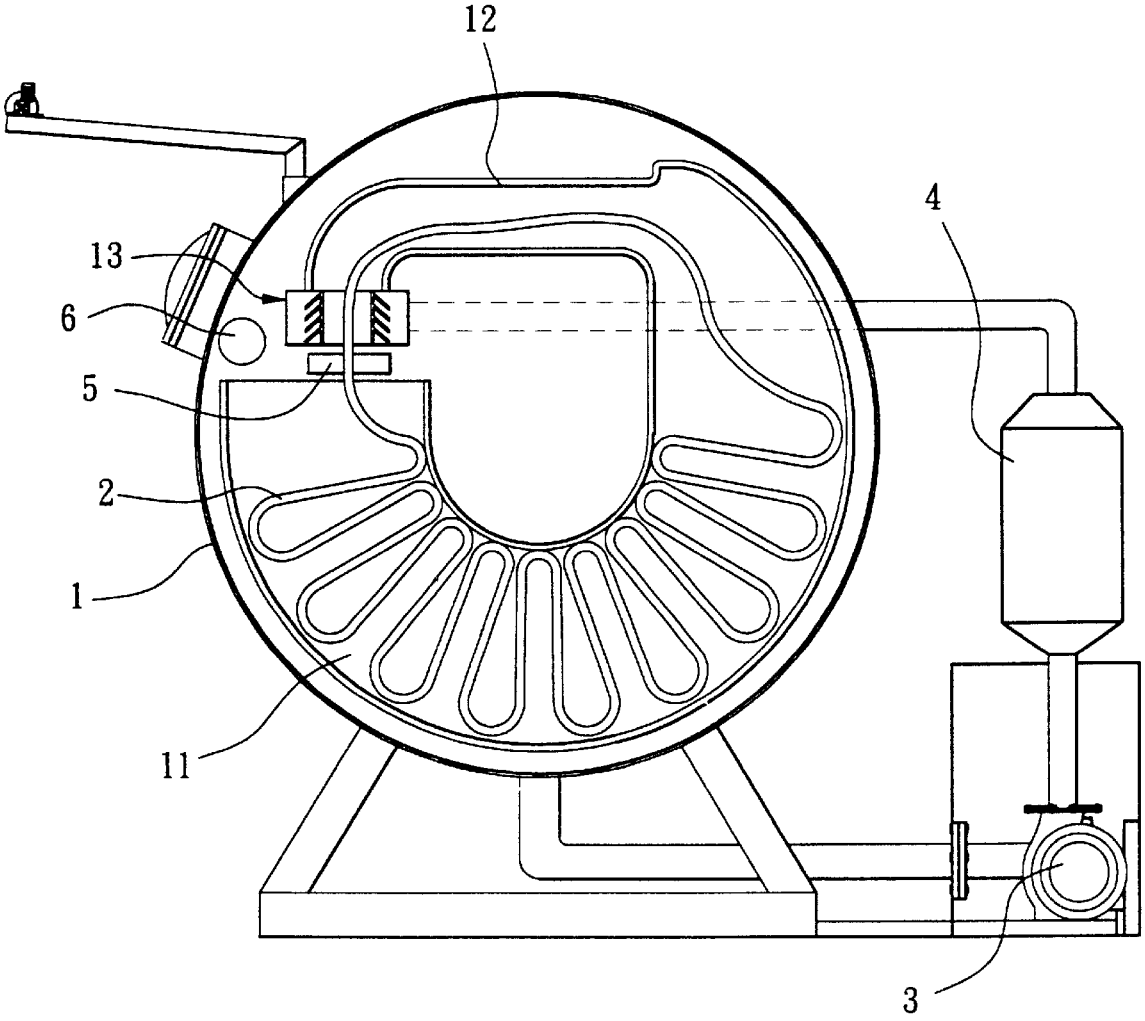
FIG. 2 is a plain view of an alternate form of the anti-pilling machine.

FIG. 2 illustrates an alternate form of the anti-pilling machine. According to this alternate form, a cloth roll-up roll 6 is provided inside the machine body 1 adjacent to the air nozzle 13 and the steam nozzle 5, and adapted for rolling up the fed piece of cloth 2 after the anti-pilling operation.

A prototype of anti-pilling machine has been constructed with the features of FIGS. 1 and 2. The anti-pilling machine functions smoothly to provide all of the features discussed earlier.

Although particular embodiments of the invention have been described in detail for purposes of illustration, various modifications and enhancements may be made without departing from the spirit and scope of the invention.

Accordingly, the invention is not to be limited except as by the appended claims.

What the invention claimed is:

1. An anti-pilling machine comprising a machine body, the machine body defining a cylindrical receiving chamber and a cloth passage for the circulation of a fed piece of cloth, said receiving chamber having a front end and a rear end, said cloth passage having a front input end terminating in a smoothly arched front bent and a rear output end connected to the rear end of said receiving chamber, an air nozzle coupled to the front bent of said cloth passage and arranged in an upwardly extended position and adapted for ejecting a stream of air toward the fed piece of cloth to force the fed piece of cloth from said receiving chamber into said cloth passage, said air nozzle having an input end downwardly facing the front end of said receiving chamber, a steam nozzle suspended between said air nozzle and the front end of said receiving chamber, an air blower disposed outside said machine body and adapted for providing forced air to said air nozzle, and a heat exchanger connected between said air blower and said air nozzle and adapted for heating and drying forced air passing from said air blower to said air nozzle.

2. The anti-pilling machine as claimed in claim 1 wherein said machine body further comprises a cloth roll-up roll disposed adjacent to said air nozzle and said steam nozzle and adapted for rolling up the fed piece of cloth.

* * * * *